United States Patent [19]

Smrekar

[11] Patent Number: 4,808,121

[45] Date of Patent: Feb. 28, 1989

[54] BOND CONNECTOR FOR SERVICE CABLE

[75] Inventor: Clarence E. Smrekar, Cleveland, Ohio

[73] Assignee: Preformed Line Products Company, Cleveland, Ohio

[21] Appl. No.: 159,702

[22] Filed: Feb. 24, 1988

[51] Int. Cl.[4] ..... H01R 4/24

[52] U.S. Cl. ..... 439/394; 439/578

[58] Field of Search ..... 439/391, 394, 427, 578–585

[56] References Cited

U.S. PATENT DOCUMENTS

| | | | |
|---|---|---|---|
| 2,040,992 | 5/1936 | Harris . | |
| 2,099,950 | 11/1937 | Whitehead et al. . | |
| 2,211,615 | 8/1940 | Brickman et al. . | |
| 3,109,052 | 10/1963 | Dumire et al. | 439/394 |
| 3,406,373 | 10/1968 | Forney, Jr. | 439/394 |
| 3,435,126 | 3/1969 | Hamilton . | |
| 3,728,665 | 4/1973 | Frey . | |
| 3,828,298 | 8/1974 | Schumacher . | |
| 4,305,179 | 12/1981 | Sakurada . | |
| 4,380,096 | 4/1983 | Nishida et al. . | |
| 4,427,248 | 1/1984 | Smith . | |

*Primary Examiner*—Joseph H. McGlynn

*Attorney, Agent, or Firm*—Fay, Sharpe, Beall, Fagan, Minnich & McKee

[57] ABSTRACT

A connector assembly for maintaining electrical continuity with a grounding shield of a service cabvle. The connector assembly includes a connector member having a first portion of substantially cylindrical conformation. Radially outward extending teeth make electrical contact with the grounding shield and mechanical connection with the insulative outer sheath. First and second spring clamps are received over the service cable to provide circumferentially continuous clamping forces between the connector member and service cable.

12 Claims, 1 Drawing Sheet

BOND CONNECTOR FOR SERVICE CABLE

This invention pertains to the art of grounding a cable sheath and more particularly to a bond connector for maintaining electrical continuity with a grounding shield of a service cable. The invention is particularly applicable to buried service cable splice applications. However, it will be appreciated that the invention has broader applications and may be advantageously employed in still other bond connector environments and applications.

A brief summary of problems encountered in service wire connections, and one solution to those problems in which maintenance of electrical continuity is required, is set forth in U.S. Pat. No. 3,435,126 to Hamilton issued Mar. 25, 1969. The flexible bond connector described in that patent includes radially inward directed prongs for mechanical and electrical connection with a grounding shield that has been exposed and folded back. Although believed to offer benefits over earlier arrangements, problems still remain with this arrangement. Namely, installation requires the grounding shield to be folded back upon itself so that the prongs can extend therethrough and mechanically engage an external surface of an insulative outer sheath To effect this fold back relationship, a detailed preparation of the service cable must be undertaken These preparatory steps all increase the time and labor for installing a connector member with the increased prospect of damaging the service cable, particularly the grounding shield or enclosed data transmission service wires Even then, the completed structural arrangement, as with other bond connectors using radially inward extending teeth, is still subject to undue crimping or compression of the service wires or, possibly, the service wires themselves could be damaged by the prongs.

Other related structural arrangements are described in U.S. Pat. No. 4,427,248 to Smith issued Jan. 24, 1984; U.S. Pat. No. 3,728,665 to Frey issued Apr. 17, 1973; and U.S. Pat. No. 3,828,298 to Shumacher issued Aug. 6, 1974. The Frey and Shumacher patents also utilize the radially inward extending tooth or prong arrangement which is subject to some of the same problems noted above. On the other hand, the Smith patent employs radially outward extending teeth on a connector member but only provides an extremely limited circumferential engagement with the grounding shield. Thus, pull-out forces imposed on that bond connector may overcome the limited area of engagement between the teeth and service cable. Also, the limited surface area interface between the bond connector and grounding shield limits the level of voltage surge that the arrangement can withstand. That is, the amount of surface area interface between the bond connector and grounding shield is related to the voltage level that the interconnection can withstand, which in Smith is limited.

The subject invention is deemed to overcome these problems and others in a simplified, easy-to-install structure.

SUMMARY OF THE INVENTION

According to the present invention, there is provided a connector assembly having a connector member with a substantially cylindrical first portion and radially outward extending teeth. A second portion of the connector member includes means for electrically connecting the connector member to an associated structure Means for clamping the connector member to an associated conductor cable is also provided.

According to a more limited aspect of the invention, the connector member first portion has a smooth-faced internal wall for sliding receipt over a conductor portion of the conductor cable.

According to yet another aspect of the invention, the clamping means includes first and second spring clamps closely received over the outer diameter of the cable.

A principle advantage of the invention is the increased mechanical gripping and electrical connecting features between the grounding shield of the service cable and the bond connector assembly.

Another advantage of the invention resides in the elimination of over-crimping problems experienced in the prior art.

Still another advantage of the invention is found in a simplified installment procedure that eliminates variables in field connections.

Yet another advantage of the invention is realized in the ability to withstand increased voltage surges while providing additional structural protection to the inner core of the cable.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figures 1, 2, 3:
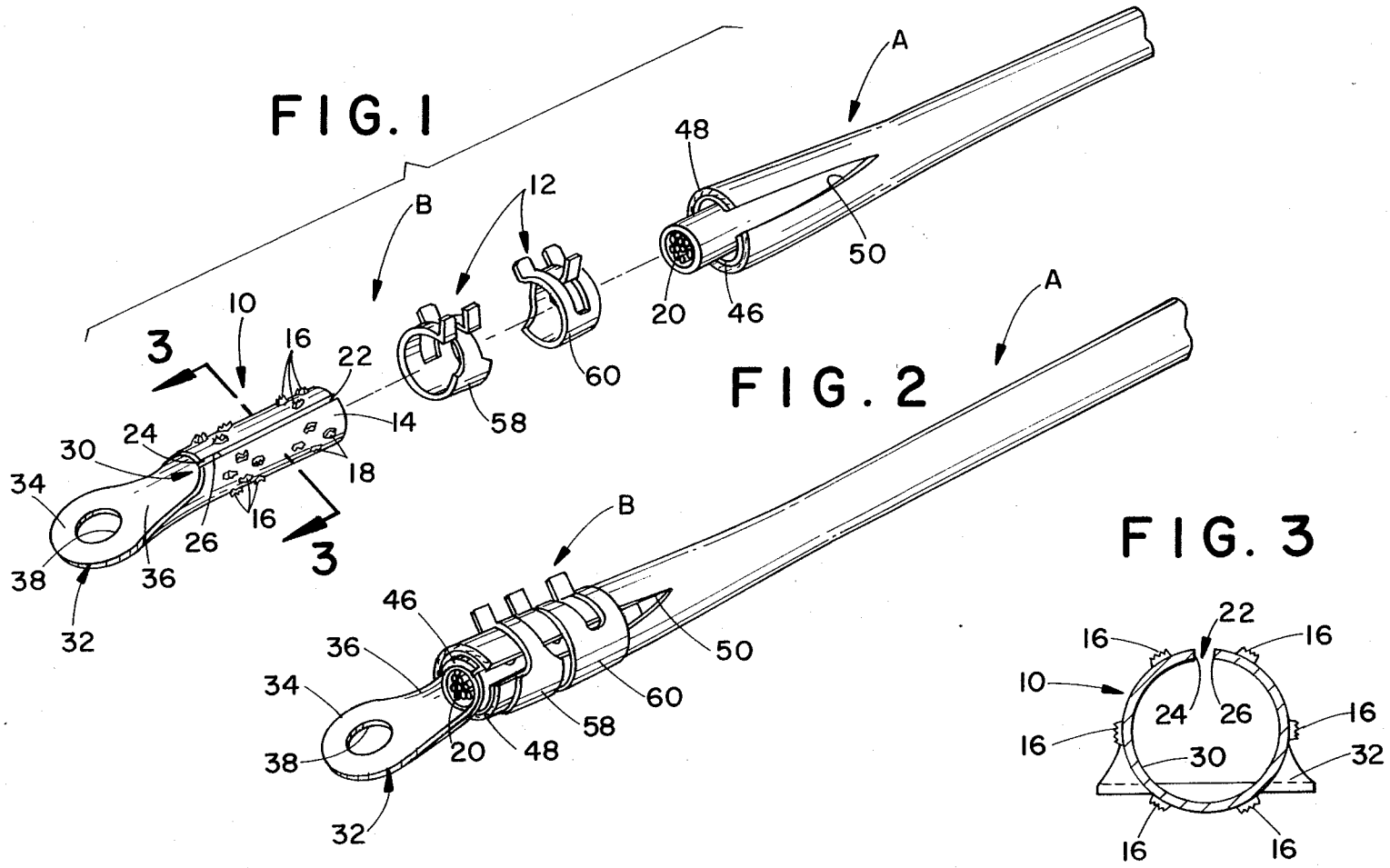
FIG. 1 is an exploded, perspective view of the subject new bond connector assembly for use with a service cable.
FIG. 2 is a perspective view of the bond connector assembly installed on the service cable; and, FIG. 3 is a cross-sectional view generally along the lines 3—3 of FIG. 1.

Referring now to the drawings wherein the showings are for purposes of illustrating the preferred embodiment of the invention only and not for purposes of limiting same, the FIGURES show a conductor cable such as service cable A and a bond connector assembly B for maintaining electrical continuity of a grounding shield of the service cable. More particularly, FIG. 1 illustrates the component parts of the bond connector assembly Preferably, the connector assembly is comprised of two major components; namely, a connector member 10 and means for clamping 12 around the periphery of the connector member. The connector member 10 includes a first portion 14 of substantially cylindrical configuration. Radially outward extending barbs, prongs, or teeth 16 are defined along the periphery of the first portion. According to a preferred method of construction, the teeth are formed through a stamping operation An aperture 18 is associated with each tooth as the connector member material is displaced in the stamping operation. Of course the teeth could be formed in an alternate manner without departing from the scope and intent of the subject invention.

The substantially cylindrical configuration of the first portion is able to withstand compressive forces imposed on the exterior of the connector member which, in turn, protects the individual service wires or conductor portion 20 of the cable. Although a complete cylinder could alternately be formed under the teachings of the subject invention, for ease in manufacturing an axially extending gap 22 is defined between opposed edges 24, 26 of the first portion. For example, a generally planar sheet of material is cut into a predetermined configuration, the stamping operation undertaken to form teeth, and the outer edges 24, 26 brought toward one another to form a substantially cylindrical configuration. An internal wall 30 of the first portion is smooth-faced for receipt over the central conductor portion 20 of the service cable as will be described further hereinbelow.

A second portion 32 of the connector member is integrally formed at one end of the first portion and includes an outwardly extending tab 34. Preferably, the tab 34 is disposed intermediate the first and second edges 24, 26 when the connector member is in the planar, prestamped configuration so that, once formed into the cylindrical configuration, it is diametrically opposed from the gap 22. A neck region 36 extends axially outward from the first portion to align the tab for interconnection with a ground lug or post (not shown). Means for electrically connecting, such as aperture 38, is defined on the tab. Of course, alternative electrical connecting arrangements such as an elongated slot may be used with equal success With continued reference to FIG. 1, and additional reference to FIG. 2, the environment of the connector member will be described in further detail. Specifically, the central conductor portion or service wires 20 themselves are received in an insulating sheath of plastic or other suitable material Encompassing the central conductor portion is a circumferentially continuous, electrically conductive grounding shield 46. The grounding shield is typically of metallic construction due to the superior conductivity properties of metal. In preferred embodiments, the grounding shield is made from aluminum or other non-corrosive metal. In still other arrangements, a non-corrosive material such as plastic will coat the inner and outer faces of the grounding shield Enclosing the entire service cable is an outer insulative sheath 48.

The connector member 10 is received over the central conductor portion 20 and beneath the grounding shield 46 The smooth-faced internal wall 30 of the connector member facilitates a sliding action of the first portion 14 over the central conductor portion. The outer sheath 48 and grounding shield 46 are cut to form a discontinuity or incision 50 in the circumferences thereof and permit the connector member to be received therebeneath. The radially outward extending teeth 16 extend into the grounding shield to assure electrical contact therewith. The teeth also extend radially, through the grounding shield to embed or engage in the outer insulative sheath 48 to provide a mechanical engagement with the cable No stripping of the outer sheath and grounding shield or other manipulative steps need be made beyond the mere incision 50. The connector member is inserted into the cable so that the first portion is preferably entirely received beneath the grounding shield Only the tab 34 will extend outward from the terminal end of the service cable (FIG. 2). As briefly described above, the cylindrical configuration of the connector member provides structural protection to the central conductor portion of the service cable. Since the first portion is substantially circumferentially continuous, it maximizes the pull-out restraint of the connector member. The increased surface area interface between the connector member and grounding shield also withstands higher voltage surges than prior art arrangements The disposition of the teeth in a radially outward manner prevents perforation of the central conductor portion which otherwise can lead to corrosion or other problems It also provides a good mechanical and electrical interconnection with the grounding shield and outer insulative sheath without requiring a great amount of field manipulation during installation.

To assist in maintaining a secure electrical and mechanical interconnection, the clamping means 12 includes first and second annular spring clamps 58, 60. The clamps are of well-known conventional design and have a predetermined inner diameter in an unbiased state that closely approximates, or is slightly less than, the outer diameter of the service cable. Biasing the spring clamps to a slightly larger diameter allows the annular clamps to be slid over the service cable with the bond connector received therein. Release of the biasing force urges the springs back toward the unbiased state that securely engages the cable in a circumferentially continuous fashion. Thus, field make-up is simple, yet secure.

The invention has been described with reference to the preferred embodiment. Obviously modifications and alterations will occur to others upon a reading and understanding of this specification. It is intended to include all such modifications and alterations insofar as they come within the scope of the appended claims or the equivalents thereof.

Having thus described the invention, it is now claimed:

1. A connector assembly comprising:

a connector member having a first portion of substantially cylindrical conformation, said first portion including radially outward extending teeth thereon adapted for electrically and mechanically connecting the first portion to a substantially circumferentially continuous region of an associated cable, a second portion of said connector member operatively engaging said first portion and including means for electrically connecting said connector member to an associated structure; and, means for clamping said connector member to the associated cable.

2. The connector assembly as defined in claim 1 wherein said connector member first portion has a smooth-faced internal surface.

3. The connector assembly as defined in claim 1 wherein said connector member first portion includes an axially extending gap therealong and said connecting means is disposed generally diametrically opposite said gap.

4. The connector assembly as defined in claim 1 wherein said second portion is integrally connected to said first portion.

5. The connector assembly as defined in claim 1 wherein said clamping means includes a spring clamp that may be selectively biased to a first diameter and relaxes to a second diameter less than said first diameter.

6. The connector assembly as defined in claim 1 wherein said clamping means includes first and second spring clamps.

7. A connector assembly adapted for use with a conductor cable having a central conductor portion encompassed by an electrically conductive grounding shield, the conductor portion and grounding shield being encompassed by an outer insulative sheath, said connector assembly comprising:

a connector member having a first portion of substantially cylindrical conformation including radially outward extending teeth, said first portion having a predetermined diametrical dimension adapted for receipt over the central conductor portion of the conductor cable and beneath the grounding shield, said teeth adapted to make electrical contact with the grounding shield and mechanical engagement with the insulative sheath;

a second portion of the connector member operatively engaging said first portion, said second portion including means for electrically connecting said connector member to an associated structure; and, means adapted for clamping said connector member to the conductor cable.

8. The connector assembly as defined in claim 7 wherein said connector member first portion has a smooth-faced internal surface adapted for sliding receipt over the conductor portion of the conductor cable.

9. The connector assembly as defined in claim 7 wherein said first portion includes an aperture associated with each tooth.

10. The connector assembly as defined in claim 7 wherein said first portion cylindrical conformation includes an axially extending gap, said second portion being diametrically opposed to said gap.

11. The connector assembly as defined in claim 7 wherein said clamping means has an annular conformation for spreading clamping forces along the entire circumference of said connector member first portion

12. The connector assembly as defined in claim 7 wherein said clamping means includes first and second spring clamps each having an unbiased internal diameter less than an outer diameter of the conductor cable.

* * * * *